US007810317B2

(12) United States Patent
Gomez et al.

(10) Patent No.: US 7,810,317 B2
(45) Date of Patent: Oct. 12, 2010

(54) CATALYTIC BURNER UTILIZING ELECTROSPRAYED FUELS

(75) Inventors: Alessandro Gomez, Orange, CT (US); Subir Roychoudhury, Madison, CT (US)

(73) Assignee: Precision Combustion, Inc., North Haven, CT (US)

( * ) Notice: Subject to any disclaimer, the term of this patent is extended or adjusted under 35 U.S.C. 154(b) by 2039 days.

(21) Appl. No.: 10/401,226

(22) Filed: Mar. 27, 2003

(65) Prior Publication Data

US 2004/0209205 A1 Oct. 21, 2004

Related U.S. Application Data

(60) Provisional application No. 60/368,120, filed on Mar. 27, 2002.

(51) Int. Cl.
*F01N 3/00* (2006.01)

(52) U.S. Cl. ..... 60/295; 60/274; 60/286; 60/303; 239/3; 239/690; 431/2

(58) Field of Classification Search ..... 60/274, 60/286, 295, 303; 48/95, 211, 197 R; 239/3, 239/690, 696, 708; 431/2
See application file for complete search history.

(56) References Cited

U.S. PATENT DOCUMENTS 4,255,121 A * 3/1981 Sugimoto ..... 431/208
4,702,903 A 10/1987 Keefer
4,965,052 A 10/1990 Lowther
5,590,526 A 1/1997 Cho
5,725,151 A * 3/1998 Hetrick et al. ..... 239/3
5,918,463 A 7/1999 Penswick
6,183,241 B1 2/2001 Bohn
6,282,895 B1 9/2001 Johansson
6,491,236 B1 * 12/2002 Keller ..... 239/399
6,513,326 B1 2/2003 Maceda
6,746,657 B2 6/2004 Castaldi
6,755,021 B2 6/2004 Johansson
6,767,518 B2 * 7/2004 Ichikawa et al. ..... 422/189
6,775,982 B1 8/2004 Kitamura (Continued)

FOREIGN PATENT DOCUMENTS

WO WO 2008048353 A2 4/2008

OTHER PUBLICATIONS

Co-pending U.S. Appl. No. 11/803,464, filed on May 14, 2007, in the names of Subir Roychoudhury, et al.; published as US 2008/0078175 on Apr. 3, 2008, cited hereinabove.

(Continued)

*Primary Examiner*—Tu M Nguyen
(74) *Attorney, Agent, or Firm*—Robert L. Rispoli

(57) ABSTRACT

A catalytic burner wherein a liquid fuel is evaporated prior to catalytic combustion by employing an electrosprayer. The catalytic burner can be made into an electrical generator by the use of a thermal to electrical energy conversion (TEEC) module.

8 Claims, 2 Drawing Sheets

U.S. PATENT DOCUMENTS

| | | | | |
|---|---|---|---|---|
| 6,857,260 | B2 | 2/2005 | Langenfeld | |
| 6,877,315 | B2 | 4/2005 | Clark | |
| 6,931,848 | B2 | 8/2005 | Maceda | |
| 2005/0028445 | A1* | 2/2005 | Roychoudhury et al. | 48/210 |
| 2007/0151154 | A1* | 7/2007 | Lyubovsky et al. | 48/197 R |
| 2008/0078175 | A1 | 4/2008 | Roychoudhury | |
| 2008/0127553 | A1* | 6/2008 | Roychoudhury et al. | 48/95 |
| 2009/0113889 | A1 | 5/2009 | Roychoudhury | |

OTHER PUBLICATIONS

Co-pending U.S. Appl. No. 12/587,593, filed on Oct. 8, 2009, in the names of Subir Roychoudhury, et al.; unpublished.

Co-pending U.S. Appl. No. 12/655,703, filed on Jan. 6, 2010, in the names of Subir Roychoudhury, et al.; unpublished.

Co-pending U.S. Appl. No. 12/655,702, filed on Jan. 6, 2010, in the names of Subir Roychoudhury, et al.; unpublished.

* cited by examiner

CATALYTIC BURNER UTILIZING ELECTROSPRAYED FUELS

CROSS-REFERENCE TO OTHER APPLICATIONS

This application claims priority to U.S. Provisional Application Serial No. 60/368,120 entitled "A Clean and Efficient Combustor based on Coupling of Electrosprays and Catalytic Grids" dated Mar. 27, 2002, the disclosure of which is incorporated in its entirety herein by reference.

This invention was developed under a contract with the Department of the Army, DARPA, Contract No. DAAD19-01-1-0664. The government may have certain rights herein.

FIELD OF INVENTION

This invention relates generally to a catalytic burner, and more specifically relates to a catalytic burner employing an electrohydrodynamic liquid fuel dispersion system, generally referred herein as an electrosprayer.

BACKGROUND OF THE INVENTION

Many catalytic combustion applications use liquid fuels. These fuels, however, must be evaporated prior to combustion. One method of evaporation uses a vaporizer wherein the liquid fuel is flowed through a nozzle onto a hot surface, which causes the liquid fuel to evaporate. Generally, vaporizers require large energy expenditures to maintain the temperature of the hot surface. In addition, when this method is employed with heavy hydrocarbons, such as Diesel fuels and jet propulsion fuels (e.g., JP-8, Jet A, etc.), equipment maintenance may become excessive. The nozzle, while not in contact with the hot surface, is in the presence of the hot surface therefore it gets quite hot. As a result, the liquid fuel within the nozzle decomposes thermally to form various solid deposits and/or coke. These deposits and/or coke eventually form blockages within the nozzle that foul or block the nozzle. Periodic maintenance is required to remove these blockages.

Yet another method of evaporation employs a spray atomizer. Generally, a spray atomizer is preferred for the evaporation of liquid fuel. A spray atomizer disperses the liquid fuel in fine droplets, in a process generally referred to as atomization, into a gas, such as air. The fine droplets increase the surface area of the liquid fuel, thus the interface between the gas and the liquid fuel is increased. Consequently, the evaporation rate of the liquid fuel into the gas is increased. These systems, however, create droplets of substantially different size and poorly disperse the droplets, which can effect overall combustion performance.

Based on the foregoing, it is the object of the present invention to overcome the problems and drawbacks of the prior art.

SUMMARY OF THE INVENTION

The invention is directed in one aspect to a method of catalytic combustion wherein a liquid fuel, which is to be combusted, is electrosprayed. In the method, a liquid fuel is electrosprayed into a gas, which includes an oxidant for the fuel in the presence of a catalyst used in the catalytic combustion. The fuel evaporates within the gas forming a mixture that is catalytically combusted. Preferably, the liquid fuel is a hydrocarbon or an alcohol and the gas is air, which contains the oxidant oxygen.

In an apparatus, i.e. catalytic burner, of the present invention, an electrosprayer is positioned relatively upstream from a catalyst. The term upstream and conversely downstream, as used herein, is based on the normal direction of travel of fluids, such as the fuel, through the catalytic burner. In a preferred embodiment as further explained below, the catalyst is supported on an electrically conductive substrate which acts as an electrode for the electrosprayer. The apparatus may also be combined with a thermal energy to electric energy module.

Electrospraying is accomplished by an electrosprayer, which is a type of atomizer. Typically in an electrosprayer, a fluid is forced under pressure through a nozzle creating a stream of fluid. A difference in electrical charge within the electrosprayer is created by a voltage differential between an electrode that imparts the electrical charge to the stream of fluid and another electrode, which is positioned proximate to the nozzle. In one type of electrosprayer, the nozzle acts as an electrode that imparts an electrical charge to the stream of fluid. For best operation, the voltage differential is quite large. To enhance the ability of the fluid to accept an electrical charge, the electrical conductivity of the fluid may be increased by the addition of a conduction additive.

When an electrically charged fluid exits the nozzle, the fluid immediately prior to discharge from the nozzle has a meniscus that causes the fluid to adopt upon exiting the nozzle a conical shape with an apex pointing downstream toward the charged electrode, which is generally at a lower voltage. As the fluid moves away from the nozzle, a ligament develops that trails from the apex. The ligament is eventually broken into fine droplets by instabilities in the flow downstream of the nozzle. This results in the formation of substantially smaller droplets than those formed by other atomization techniques, such as spray atomizers.

Electrospraying offers the advantages with respect to other atomizing techniques of: producing a ligament that can be orders of magnitude smaller than the cross-section of the nozzle, which allows for the generation of very small droplets from a large nozzle thereby reducing the potential for clogging of the nozzle; producing more uniform droplets thereby making the rate of evaporation of the droplets generally more uniform; and providing increased dispersion of droplets.

DETAILED DESCRIPTION OF THE PREFERRED EMBODIMENT

Figure 1:
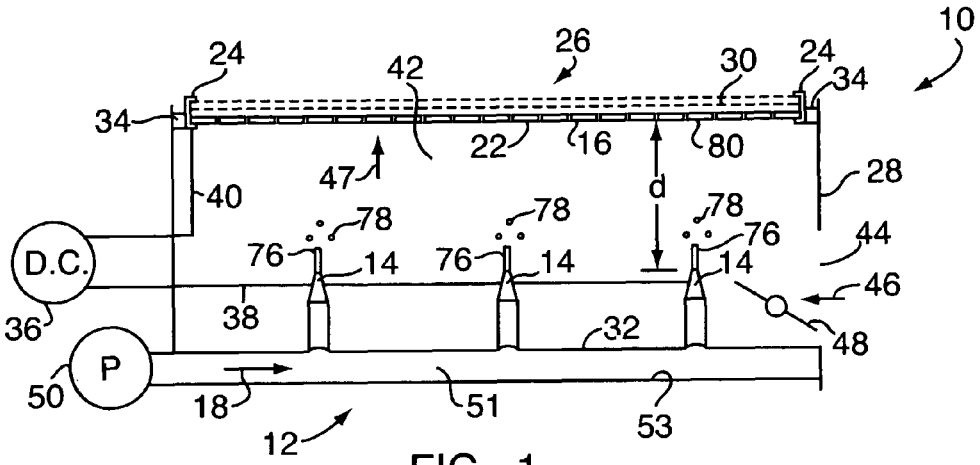
FIG. 1 shows a cross-sectional view of a catalytic burner.

As shown in FIG. 1, a catalytic burner of the present invention, generally designated by the reference number 10, includes an electrosprayer 12 having at least one nozzle 14. A catalyst 16 is placed downstream of the at least one nozzle 14.

The catalyst 16 is positioned at the surface of at least a portion of a substrate 22. One or more substrates 22 may be secured within an annular ring 24 having a c-shaped cross-section into which the edges of the substrates 22 are placed thereby defining a catalytic bed 26. The substrates 22 and annular ring 24 may be made from electrically conductive material.

Still referring to FIG. 1, a housing 28, which may be made from an electrically conductive material, defines an opening 30. On a surface 32 of the housing 28 opposed to the opening 30 is at least one nozzle 14 oriented such that a fuel 18 exits the nozzle toward the opening. The catalytic bed 26 is placed across the opening 30. Insulators 34 are provided between the catalytic bed 26 and the housing 28 to electrically isolate the catalytic bed 26 from the at least one nozzle 14.

A direct current power source 36 has one lead 38 connected to the at least one nozzle 14, thereby defining the at least one nozzle as an electrode. Another lead 40 from the power source 36 is connected to the catalytic bed 26, making the catalytic bed, substrates 22 and annular ring 24, another electrode.

A mixture flow conduit 42, defined by the housing 28, extends between the surface 32 of the housing 28 and the catalyst 16. The housing 28 defines a port 44 exiting into the mixture flow conduit 42 for introducing a gas 46 into the mixture flow conduit where it mixes with the fuel 18 to create a mixture 47. The port 44, preferably positioned to permit all the gas 46 to enter the mixture flow conduit 42 upstream of the at least one nozzle 14, has a cross-section that may be changed by a valve 48 to regulate the amount of gas flowing through the port.

A pump 50 connects to a fuel flow conduit 51, defined by at least one surface 53, that is common to the least one nozzle 14. The pump 50 pressurizes the fuel 18 so that it flows through the at least one nozzle 14.

Figure 2:
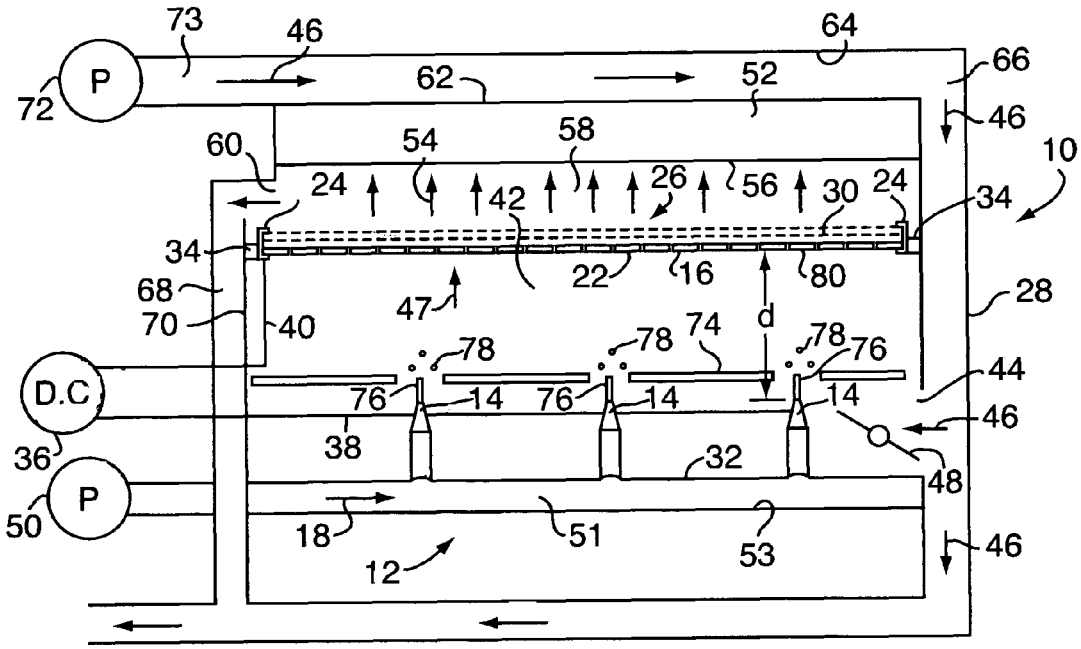
FIG. 2 shows a cross-sectional view of the catalytic burner of FIG. 1 in combination with a thermal energy to electrical energy (TEEC) module.

The catalytic burner 10 presented above can be used in combination with a conventional thermal energy to electric energy (TEEC) module to produce electricity, i.e. be an electrical generator. As shown in FIG. 2, the TEEC module 52 is placed downstream of the catalytic bed 26 such that an exhaust gas 54, created by the catalytic combustion of the mixture 47 within the catalytic bed, impacts upon a heat surface 56 of the module. Impacting of the exhaust gas 54 on the heat surface 56 of the module 52 assures maximum heat exchange between the exhaust gas and the module. The heat surface 56 of the module 52 cooperates with the catalytic bed 26 and the housing 28 to create an intermediate flow conduit 58 to an exhaust port 60, which is defined by the housing.

A cool surface 62 of the module 52 in cooperation with at least one surface 64 defines a gas input flow conduit 66 that is in downstream fluid communication with an exhaust flow conduit 68, which is defined by at least one surface 70, extending from the exhaust port 60. The gas input flow conduit 66 is in downstream fluid communication with the mixture flow conduit 42 via the port 44.

A pump 72, such as a fan, is provided at an entrance 73 into the gas input flow conduit 66 to provide a means to force the gas 46 through the gas input flow conduit. Increased gas 46 flow over the cool surface 62 of the module 52 may increase the overall efficiency of the module.

A perforated plate 74 is positioned between the at least one nozzle 14 and the catalytic bed 26 within the mixture flow conduit 42. The perforated plate 74 acts as a mixer to assist in evaporation of the fuel 18 and to create a more uniform mixture 47.

The method of the present invention will now be explained within the context of the above-described apparatus. The fuel 18 is pressurized by the pump 50 and forced though the at least one nozzle 14 towards the catalytic bed 26. The direct current power source 36, which has one lead 38 connected to the at least one nozzle 14, electrically charges the fuel 18 as it passes through the at least one nozzle.

As the fuel 18 exits the at least one nozzle 14, a ligament 76 is created as a result of the voltage difference between the fuel and the catalytic bed 26. The ligament 76 extends from the at least one nozzle 14 in the direction of the catalytic bed 26. Instability in the ligament 76 causes the ligament to break into numerous droplets 78. At least a portion of the droplets 78 evaporate within the gas 46 and mix with the gas to create the mixture 47 that flows into the catalytic bed 26, where it is catalytically combusted forming the exhaust gas 54.

In steady state operation, the catalytic combustion, which is exothermic (releases heat), will entrain the mixture 47 into the catalytic bed 26, thereby giving the fuel 18 and the gas 46 within the mixture flow conduit 42 a mass flow rate and a velocity. The gas 46 in the mixture flow conduit 42 may be replenished by the natural draw of gas through the port 44. The valve 48 may regulate the mass flow rate of the gas 46.

The mixture flow conduit 42 has a distance "d" between the at least one nozzle 14 and the catalyst 16, generally assumed to be an inlet face 80 of the catalytic bed 26. The distance "d" and the velocity of the fuel 18 and gas 46 within the mixture flow conduit 42 define a maximum residence time for the fuel and gas within the mixture flow conduit. This in turn determines the amount of evaporation of the fuel 18 and the degree of mixing of the evaporated fuel with the gas 46 before the mixture 47 is brought into the catalytic bed 26.

The basic method may be modified when a TEEC module is employed with the catalytic burner. As shown in FIG. 2, the gas 46 may be pumped down the gas inlet flow conduit 66. Pumping of the gas 46 gives the gas a mass flow greater than that caused by the natural draw of the catalytic burner 10. The increased gas 46 flow over the cool surface 62 of the module 52, however, may increase the efficiency of the module. As the quantity of gas 46 is above that needed by the catalytic burner 10, the excess gas 46 is discharged through the gas inlet flow channel 66, which is in downstream fluid communication with the exhaust gas flow conduit 68.

As those skilled in the art of catalytic combustion will appreciate, there are numerous combinations of fuels, oxidants, and catalysts. It should be readily appreciated that the catalyst 16 and the catalytic bed 26 and any mixture 47 could be engineered to permit partial combustion or near total combustion within the catalytic bed 26. It should also be appreciated that in the case of partial combustion, a flame may develop downstream of the catalytic bed 26, depending upon whether the exhaust gas 54 is within its flammability limits and ignition can be achieved. It should also be appreciated that startup of the catalytic burner 10 may necessitate preheating of the catalyst 16. One possible method of preheating the catalyst 16 when the catalytic bed 26 employs an electrically conductive substrate 22 is electric resistance heating of the substrate.

EXAMPLE

A catalytic burner, consistent with that depicted in FIG. 1, was constructed and operated in a manner consistent with the method. The catalytic burner was designed for use with a conventional TEEC module capable of delivering 20 Watts of electrical power. Based on a 20-Watt electric power delivery requirement, it was determined that the catalytic burner would have to have a thermal energy output on the order of 100 Watts. Using a typical heating value of 42,500 J/gm for hydrocarbon fuels, a 100 Watt thermal energy output translated into a catalytic burner capable of combusting a hydrocarbon fuel at a fluid flow rate of 7-8 grams/hour.

The liquid hydrocarbon fuel JP-8 was selected. JP-8 was selected because it is a readily available liquid hydrocarbon fuel that is well suited to electrospraying, once its electrical conductivity is enhanced by a suitable additive (e.g., an anti-static additive). Demonstrating successful operation with JP-8 implies that operation with other fuels is also possible, such as other n-dodecanes (a single component fuel having similar physical properties). Air was selected as the gas as it contains the desired oxidant oxygen. The catalyst was 80% palladium and 20% platinum deposited on an alumina wash-coat. The substrate was a MICROLITH® substrate from Precision Combustion, Inc. of North Haven, Conn.

The number of nozzles and the arrangement of the nozzles were based on the size of the droplet and dispersion of the droplets necessary to achieve the desired evaporation rate. As discussed above, the evaporation rate determines the size of the catalytic burner, as it sets the distance "d" needed to obtain the mixture.

The droplet size for any given fluid from a nozzle of an electrosprayer is primarily a function of fluid flow rate therethrough. The greater the flow rate, the greater the droplet size. Thus, the number of nozzles required is a function of the droplet size and the total flow rate required. The greater the droplet size the greater the residence time required, i.e., the longer the distance d, for the droplet to evaporate and mix with the oxidant.

In order to meet the fuel flow rate required, a PEEK manifold connected multiple stainless steel capillaries, i.e., nozzles, arranged in a hexagonal pattern. The capillaries were mounted in a hexagon pattern to maximize the number of capillaries in a given cross-sectional area and maintain each capillary at a fixed distance from one another, thereby minimizing interference between capillaries. The capillaries were mounted through a flange capable of withstanding high temperatures, with the tips of each capillary sharpened and polished to eliminate burrs, which can affect the pattern of the electrical field created within the electrosprayer. The flange was supported within a cylindrical Pyrex housing, which was transparent, thereby permitting viewing of the spray pattern and electrically isolate the capillaries from the catalytic bed. To simulate heat recuperation, which may be desired in the complete system to increase the thermodynamic efficiency, the gas was preheated to 500 degrees C. A voltage differential was created between the catalytic bed and each capillary of several kV.

To characterize the performance of the catalyst, the surface temperature and the uniformity thereof of the catalytic bed and the exhaust gas composition were measured. The temperature on the surface of the catalytic bed was measured using a PV-320 Electrophysics infrared video camera with a germanium objective lens. The exhaust gas composition was estimated by obtaining a series of samples, each being analyzed by a two-channel Micro-Gas Chromatograph from Agilent Technologies.

A fuel equivalence ratio, i.e., the actual fuel/air ratio divided by the stoichiometric fuel/air ratio, was selected based on the requirements of the assumed TEEC module. Variations in equivalence ratio may allow for operation over a much broader temperature range.

Figure 3:
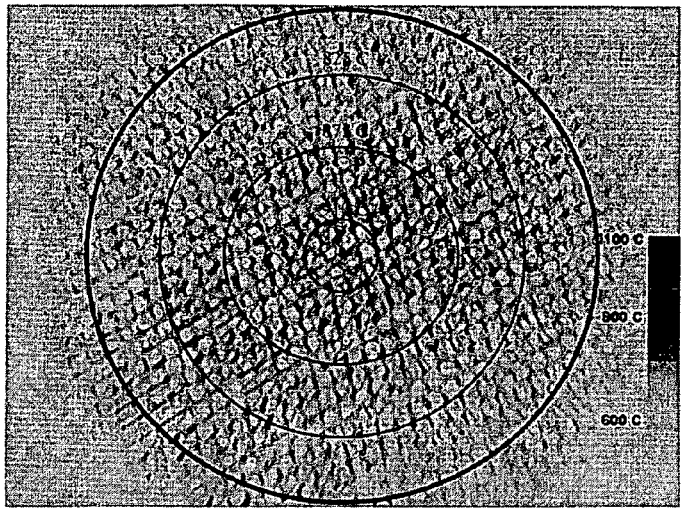
FIG. 3 is a graph illustrating the temperature across the catalytic bed within the catalytic burner.

FIG. 3 is a typical two-dimensional map of temperature of the catalytic bed. This result corresponds to a fuel equivalence ratio of 0.48 (a lean mixture) at a fuel flow rate of 9.8 grams/hour. Radial temperature scans of the catalytic bed indicated a 5 percent, plus or minus, variation in temperature across an exit face of the catalytic bed. In this case the maximum temperature achieved was approximately 1100 degrees K.

Figure 4:
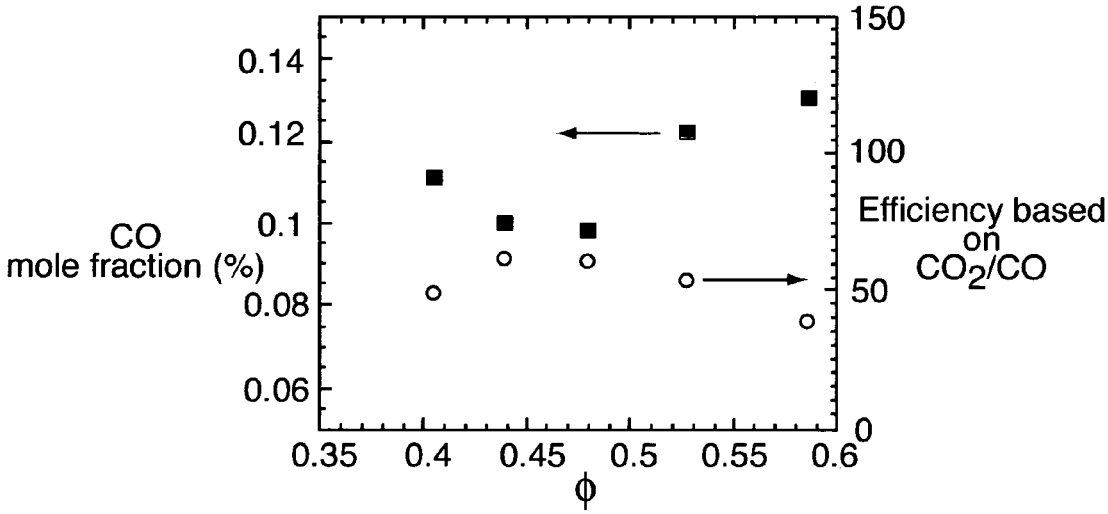
FIG. 4 is as graph of efficiency of a catalytic burner based on a mass flow rate of 9.7 grams/hr. of n-dodecane.

For a base case of operation with n-dodecane having a fuel equivalence ratio of 0.48 and a fuel flow rate of 9.7 grams/hr, gas chromatographic measurements of mole fractions of the main components, $N_2$, $O_2$, $CO_2$, and CO, in a dry gas sample of the exhaust gas yielded 81.5%, 11.5%, 6.4%, and 0.11%, respectively. Light hydrocarbons such as $CH_4$, and $C_2H_6$, as well as $H_2$ were below detectable levels (550 ppm). This gives an estimated efficiency of combustion of 99%. As shown in FIG. 4, if $CO_2$/CO is used as a surrogate for efficiency, for a fuel flow rate of 9.7 grams/hr the maximum combustion efficiency for this catalytic burner occurs at a fuel equivalence ratio of 0.45.

It is particularly important to note that 100% combustion within a catalytic bed cannot be accomplished unless the catalytic bed is infinitely long. Therefore, the language and terminology used herein should be interpreted within the context of catalytic combustion systems.

The invention has been described in considerable detail based on a preferred embodiment. Therefore, the spirit and scope of the invention should not be limited to the description of the preferred versions contained herein. For example, the pumps may be gravimetrically created and other catalytic beds could be used. In addition, the electrodes do not have to be the components identified, nor does the mixture flow conduit have to be linear. These are but a few examples.

What is claimed is:

1. A method of catalytic combustion comprising:

providing a supply a fuel wherein a conduction additive is added to the fuel to enhance the ability of the fuel to accept an electrical charge;

electrospraying the fuel through an electrosprayer having at least one nozzle into a gas having an oxidant;

evaporating the electrosprayed fuel;

mixing the evaporated fuel with the gas to create a mixture; and catalytically combusting the mixture in the presence of a catalyst in a catalytic bed;

wherein at least one nozzle is made of an electrically conductive material defining the nozzle as an electrode, and wherein the catalyst is supported on an electrically conductive substrate defining another electrode.

2. The method of claim 1 wherein the step of catalytically combusting the mixture produces a flammable exhaust gas.

3. The method of claim 1 wherein the step of catalytically combusting the mixture produces a nonflammable exhaust gas.

4. The method of claim 1 wherein a direct power supply is connected to at least one nozzle and is also connected to the substrate.

5. The method of claim 1 wherein the fuel is a hydrocarbon.

6. The method of claim 5 wherein the gas is air.

7. The method of claim 1 wherein in the step of catalytically combusting the mixture, the mixture is catalytically combusted within a catalytic bed having a catalyst supported on a screen substrate.

8. The method of claim 7 wherein the screen substrate is made from a material that is electrically conductive.

* * * * *